United States Patent [19]

Byrd et al.

[11] 4,210,097

[45] Jul. 1, 1980

[54] MEANS FOR MAINTAINING A NON-OXIDIZING ATMOSPHERE AT POSITIVE PRESSURE WITHIN THE METALLIC STRIP PREPARATION FURNACE OF A METALLIC COATING LINE DURING LINE STOPS

[75] Inventors: Fred Byrd, Lebanon; James A. Fisher, Middletown, both of Ohio

[73] Assignee: Armco Inc., Middletown, Ohio

[21] Appl. No.: 7,659

[22] Filed: Jan. 29, 1979

Related U.S. Application Data

[62] Division of Ser. No. 768,033, Feb. 14, 1977, Pat. No. 4,148,946.

[51] Int. Cl.[2] ..... F27B 9/28; C23C 1/00

[52] U.S. Cl. ..... 118/65; 118/67; 118/69; 118/419; 427/319; 427/321; 148/156; 432/8; 432/2; 432/4; 432/200

[58] Field of Search ..... 427/319, 321, 320; 148/156; 118/419, 420, 65, 67, 68; 432/2, 4, 8, 200; 266/103; 98/48

[56] References Cited

U.S. PATENT DOCUMENTS

| | | | |
|---|---|---|---|
| 1,890,065 | 12/1932 | Meehan | 148/156 |
| 2,711,683 | 6/1955 | Ryder | 98/48 |
| 3,222,042 | 12/1965 | Fritz | 432/8 |
| 3,396,951 | 8/1968 | Cope et al. | 427/329 |
| 3,827,854 | 8/1974 | Gildersleeve | 432/8 |

*Primary Examiner*—Ralph S. Kendall
*Attorney, Agent, or Firm*—Frost & Jacobs

[57] ABSTRACT

In a line for coating a ferrous base metal strip with a molten coating metal, the line being of the type having a preparation furnace for the strip comprising a direct fired furnace, a controlled atmosphere heating furnace, one or more cooling chambers and a snout leading beneath the surface of the molten coating metal bath, all in sealed relationship to each other, the improvement comprising a method and means for maintaining a non-oxidizing atmosphere at positive pressure within the entire preparation furnace during line stops. To this end, a retractable, refractory lined door means is provided in the conduit between the direct fired furnace and its exhaust fan to seal off the direct fired furnace from its exhaust fan and an air dilution opening in that conduit. Additionally, means are provided to add excess nitrogen flow to the preparation furnace to maintain a positive pressure therein. Thus, during a line stop, the refractory lined door will be shifted from its normal retracted position to its position sealing off the direct fired furnace and the means for adding excess nitrogen will be actuated to maintain a positive pressure within the entire strip preparation furnace of the metallic coating line.

5 Claims, 2 Drawing Figures

MEANS FOR MAINTAINING A NON-OXIDIZING ATMOSPHERE AT POSITIVE PRESSURE WITHIN THE METALLIC STRIP PREPARATION FURNACE OF A METALLIC COATING LINE DURING LINE STOPS

CROSS REFERENCE TO RELATED APPLICATION

This is a division of application Ser. No. 768,033, filed Feb. 14, 1977, U.S. Pat. No. 4148946 in the name of the same inventors and entitled METHOD AND MEANS FOR MAINTAINING A NON-OXIDIZING ATMOSPHERE AT POSITIVE PRESSURE WITHIN THE METALLIC STRIP PREPARATION FURNACE OF A METALLIC COATING LINE DURING LINE STOPS--.

BACKGROUND OF THE INVENTION

1. Field of the Invention

This invention relates to improvements in the method and means for pretreating a ferrous base metal strip in a metallic coating line, and more particularly to a method and means for maintaining a non-oxidizing atmosphere at positive pressure within the strip preparation furnace of the metallic coating line during line stops.

2. Description of the Prior Art

The method and means of the present invention are applicable to various types of metallic coating lines. For purposes of an exemplary showing, however, the present invention will be described in this application to a hot dip metallic coating line of the general type taught in U.S. Letters Pat. No. 3,936,543.

In recent years, pretreatment or preparation of a ferrous base metal strip, prior to dipping in a bath of molten coating metal, has been carried out by the so-called Selas process (a detailed description of which may be found in U.S. Pat. No. 3,320,085, issued May 16, 1967 to C. A. Turner, Jr.), or a modification thereof. This process contemplates a direct fired funace wherein oils and foreign materials are removed from the surfaces of the ferrous base metal strip, a heating furnace (having a hydrogen-nitrogen atmosphere) wherein the strip is brought to the desired maximum temperature to achieve the required final characteristics of the base metal strip and one or more cooling chambers wherein the ferrous base metal strip is brought down to a temperature compatable with the bath of molten coating metal into which it is to be immersed. The direct fired furnace, controlled atmosphere heating furnace and cooling chamber or chambers are connected in sealed relation so that the entire preparation furnace of the line can be operated above atmospheric pressure by controlling the discharge rate of the combustion products in the direct fired furnace. While the direct fired furnace controlled atmosphere heating furnace and one or more cooling chambers may be horizontally oriented with the strip passing therethrough on appropriately arranged support rolls, the more common present day arrangement contemplates a vertically oriented direct fired furnace, a vertically oriented controlled atmosphere heating furnace and one or more vertically oriented cooling chambers, the strip passing therethrough in vertical flights, guided by rolls at the upper and lower ends of the direct fired furnace, controlled atmosphere heating furnace and one or more cooling chambers. From the last cooling chamber, the strip is conducted through a snout, the end of which is submerged beneath surface of the molten coating metal in the coating pot so that through its passage through the preparation furnace of the line and into the bath of molten coating metal the strip will travel through controlled atmospheres. An example of a coating line preparation furance of the type contemplated, is taught and illustrated in U.S. Pat. No. 3,837,790.

Heretofore, during line stops the exhaust fan of the direct fire furnace would withdraw gases from the preparation furance of the metallic coating line. With the direct fired furnace shut down, these gases comprise primarily hydrogen and nitrogen from the controlled atmosphere heating furnace and one or more cooling chambers. The loss of these gases not only constitutes an expense, but also results in a loss of pressure within the entire preparation furnace, enabling oxygen from the ambient atmosphere to enter into the elements of the preparation furnace through openings and seams therein. This, in turn, will result in oxidation and scaling of that part of the strip located within the preparation furance of the coating line. When this portion of the strip is caused to pass through the bath upon start up, coating defects will appear on the strip by virtue of the oxidation and scaling. The oxidation and scaling may also produce bath contamination and damage to the pot rolls. The presence of oxygen in the snout may result in the collection of impurities within the snout, and dross build-up when the molten coating metal is aluminum.

By providing a method and means for sealing the direct fired furnace from the conduit leading to its exhaust fan and the air dilution opening in that conduit, and upon the addition of excess nitrogen within the preparation furnace portion of the coating line, the entrance of oxygen from the ambient atmosphere about the direct fired furnace, controlled atmosphere heating furnace one or more cooling chambers and snout will be prevented. Heat loss within these elements will also be reduced, resulting in a reduction in the amount of warmer coils used to return the line to prime production after a lengthy line stop.

The advent of the Selas-type furnace treatment process brought the benefit of being able to maintain a positive pressure throughout the preparation furnace while the coating line is operating. The method and means of the present invention extend that same benefit of maintaining a positive pressure to down-time as well as operating time

SUMMARY OF THE INVENTION

The method and means of the present invention are applicable to that type of strip preparation furnace of a coating line which incorporates a direct fired furnace, a controlled atmosphere heating furnace, one or more cooling chambers and a snout, the free end of which extends below the surface of the molten coating metal b. All of these elements are joined together in sealed relationship. The direct fired furnace is connected by conduit means to an exhaust far which draws the products of combustion from the direct fired furnace to the atmosphere or to pollution control means, the nature of which are well known in the art and does not constitute a part of the present invention.

The conduit connecting the direct fired furnace and its exhaust f will normally be provided with an air dillution opening so that the products of combustion or exhaust gases withdrawn from the direct fired furnace by the exhaust fan during line operation will be diluted with respect to their heat content.

In accordance with the method and means of the present invention a refractory lined door means is provided in association with the duct connecting the direct fired furnace with its exhaust fan. The door is shiftable between a normal open or retracted position wherein the products of combustion are free to be drawn through the conduit by the exhaust fan and an extended or closed position during line stop wherein it seals the direct fired furnace from the exhaust fan and the air dilution openings in the duct. The door means is refractory lined since the gases within the direct fired furnace are normally at a temperature of at least 2300° F. (1260° C.) The door means is preferably located in association with the air dilution openings in the conduit so that when the door means is in its extended or closed position, the exhaust fan can continue to draw air above the door means to cool the door means.

The invention also contemplates means for the introduction of excess nitrogen at a positive pressure within the preparation furnace to maintain a positive pressure so as to prevent the entrance therein of oxygen from the ambient atmosphere, and to serve as a safe, non-oxidizing atmosphere to prevent oxidation and scaling of the surfaces of the strip within the preparation furnace.

DESCRIPTION OF THE PREFERRED EMBODIMENTS

Figure 1:
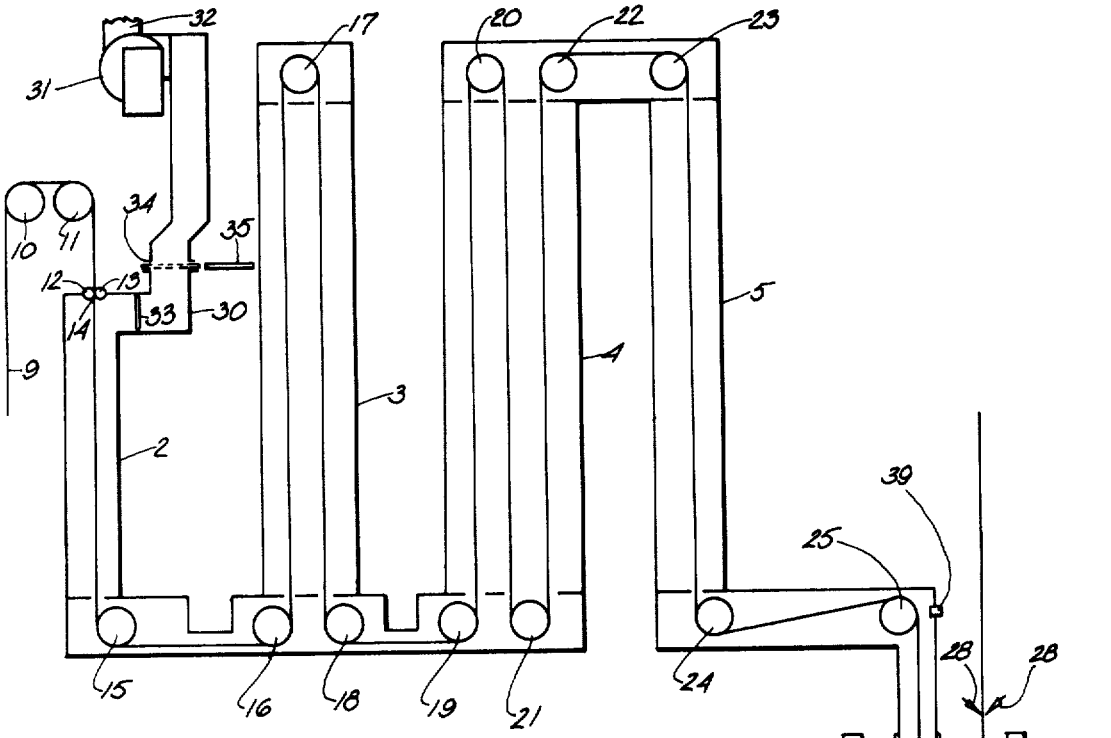
FIG. 1 is a diagrammatic representation of a hot dip metallic coating line illustrating the molten metal coating pot and the strip preparation furnace portion of the line provided with the apparatus of the present invention.

Turning first to FIG. 1, strip preparation furnace of the coating line comprises a direct fired furnace 2, a controlled atmosphere heating furnace 3, a first cooling section 4, a second cooling section 5 and a snout 6. It will be noted that snout 6 is configured to extend below the upper surface of a molten coating metal bath 7 located in a coating pot 8.

The ferrous base metal strip 9 to be prepared enters the direct fired furnace 2 over rolls 10 and 11 and through sealing roll 12 and 13 so located as to minimize the escape of products of combus through the entrance opening 14 of preheat furnace 2. The direct fired furnace 2 operates at a temperature on the order of 2300° F. (1260° C.). The function of the direct fired furnace is to quickly burn oil and the like from the surface of strip 9 while providing partial heating for annealing the strip 9. The direct fired furnace, at the temperature indicated, will be sufficient to heat the entering strip to a temperature of from about 1000° F. (538° C.) to about 1400° F. (760° C.) by the time it passes from direct fired furnace 2 to controlled atmosphere heating furnace 3.

The strip 9 passes about turn-around rolls 15 and 16 and begins its upward travel through controlled atmosphere heating furnace 3. Thereafter, the strip passes about turn-around roll 17 and downwardly again through furnace 3. Preferably, the controlled atmosphere heating furnace section of the strip preparation furnace is of the radiant tube type and will serve to further raise the temperature of strip 9 to from about 1200° F. to about 1700° F. (about 650° C. to about 927° C.), depending upon the nature of the ferrous base metal strip 9 and the desired final characteristics of the base metal strip.

As indicated above, the strip preparation furnace of the coat line may have one or more cooling chambers. For purposes of an exemplary showing the strip preparation furnace is illustrated as having two cooling chambers 4 and 5. From the controlled atmosphere heating furnace 3 the strip 9 passes about turn-around rolls 18 and and enters cooling chamber 4. Chamber 4 may be of the tube cooling well known in the art. In the exemplary illustration, the ferrous 9 makes three vertical flights through cooling chamber 4, passing about turn-around rolls 20 and 21. Thereafter, the ferrous base m strip passes about turn-around rolls 22 and 23 to enter the second cooling chamber 5 which may be of the jet cooling type, again well known in the art.

The temperature to which the ferrous base metal strip 9 is cooled will depend upon a number of factors. Of primary consideration is the nature of the molten metal bath 7 is coating pot 8 with which the ferrous base metal strip is to be coated. For example, where molten coating metal is zinc, the ferrous base metal strip will be cooled to approximately 850° F. (454° C.) Where the molten coating metal is aluminum, a strip temperature of approximately 1250° F. (680° C.) normally used. In some instances, the strip itself may be used as an additional means to introduce heat into the molten coating metal bath 7. In such an instance, the strip may be introduced into the bath at a temperature somewhat higher than the melting point of the bath. In other instances, where the strip is not relied upon as one of the heat sources for the bath, the strip may be introduced into the bath at a temperature slightly below that of the bath.

From the cooling chamber 5 the ferrous base metal strip 9 passes about turn-around roll 24 and enters snout 6. The free end of snout 6 extends downwardly below the surface of the molten metal bath 7. The ferrous base metal strip passes about turn-down roll 25 and is directed downwardly into bath 7. Within the bath, the strip is guided by coating pot rolls 26 and 27 so as to exit the bath in a vertical flight. Upon exiting the bath the strip has excess coating metal removed from its surfaces by any appropriate and well known finishing means. For purposes of an exemplary showing, a pair of jet knives 28 and 29 is illustrated in FIG. 1. It will be understood by one skilled in the art that for purposes of this invention any coating metal appropriate for use on a ferrous base metal strip may be used for bath 7, as for example aluminum, zinc, alloys of aluminum, alloys of zinc and terne.

The parameters under which the strip preparation furnace of the coating line is run do not constitute a limitation on the present invention. The above noted U.S. Pat. No. 3,320,805, for example, teaches passing the ferrous base metal strip through direct fired furnace 2, heated to a temperature above 2400° F. (1315° C.) by direct combustion of fuel and air therein to produce gaseous products of combustion containing at least about 3% combustibles in the form of carbon monoxide and hydrogen the strip reaching a temperature of from about 797° F. to about 1301° F. (about 425° C. to about 705° C.) while maintaining bright steel surfaces completely free from oxidation. The ferrous base metal strip 9 is then passed into controlled atmosphere heat furnace 3 containing a hydrogen and nitrogen atmosphere where it is further heated by the radiant tubes to from about 797° F. to about 1697° F. (about 425° C. to about 925° C.) and thereafter cooled approximately to the molten coating metal bath temperature in cooling chambers 4.

U.S. Pat. No. 3,936,543 teaches a process wherein higher combustion efficiency and better production rates are achieved. The ferrous base metal strip 9 is heated to from about 1004° F. to about 1301° F. (about 540° C. to about 705° C.) in the direct fired furnace 2, heated to at least about 2201° F. (1205° C.) and containing gaseous products of combustion ranging from about 3% by volume oxygen to about 2% by volume excess combustibles in the form of carbon monoxide and hydrogen. Preferably the direct fired furnace atmosphere contains 0% oxygen and 0% excess combustibles, i.e. perfect combustion. This results in the formation of a thin iron oxide layer on the ferrous base metal strip 9 which is reduced in the controlled atmosphere heating furnace 3. The strip is thereafter cooled in cooling chambers 4 and 5 to a temperature approximating that of the molten coating metal bath 7.

It will be noted from FIG. 1 that the upper end of direct fired furnace 2 is connected by conduit 30 to an exhaust fan 31. The outlet 32 of exhaust fan 31 may be connected directly to a stack or to pollution control means (not shown). As indicated above, the strip preparation furnace of the coating line can be operated above atmospheric pressure (to prevent the introduction therein of oxygen from the ambient atmosphere) by controlling the discharge rate of the products of combustion from the direct fired furnace 2. To this end, a damper 33 is located in conduit 30.

In the usual practice, the conduit 30 is provided with an air dilution opening. Exhaust fan 31 will draw ambient air into conduit 30 to cool and dilute the products of combustion passing through conduit 30 prior to their passage through exhaust fan 31 and outlet 32 to pollution control means or the like. An exemplary air dilution opening is illustrated in the form of a gap 34 in conduit 30.

Figure 2:
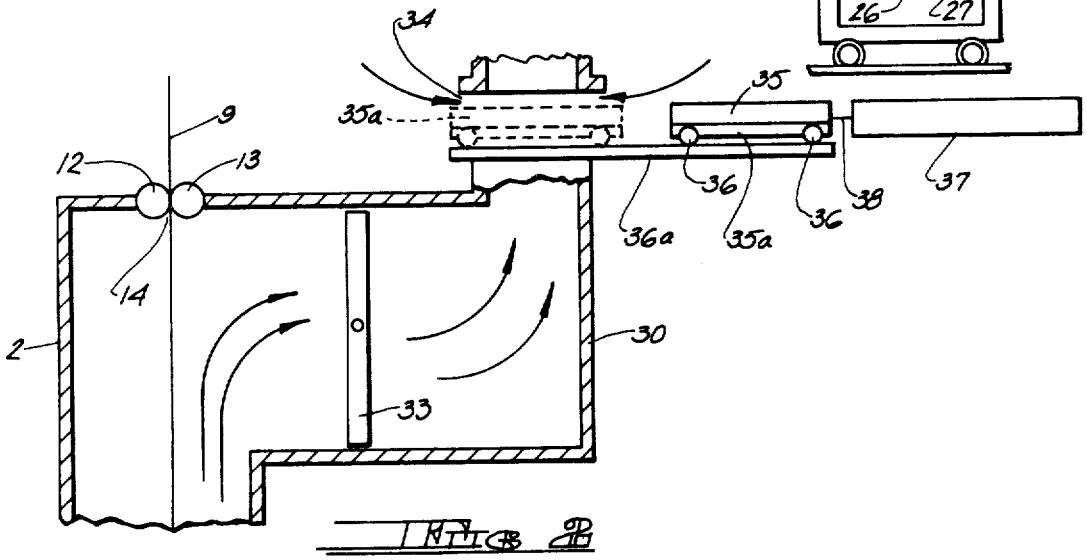
FIG. 2 is a fragmentary enlarged view of the upper end of the direct fired furnace and its conduit to its exhaust fan, partly in cross section, and illustrating the door means in both its open and closed positions.

FIG. 2 is a fragmentary enlargement, partially in cross section of the upper end of direct fired furnace 2 and the lower end of conduit 30. In accordance with the present invention, a door means is provided to seal off the upper end of direct fired furnace 2 from exhaust fan 31 and air dilution opening 34. The door means may take any form appropriate to achieve the purposes of the present invention. An exemplary door means is illustrated at 35. The door means is shiftable between a retracted or opened position as shown and an extended or closed position (shown in broken lines at 35*a*). The door means is so sized as to be insertable in conduit 30 through the air dilution opening or gap 34, the bottom surface of door 35 closing conduit 30. As is shown, the door means may have a thickness less than the height of opening or gap 34 so that when the door means is in its closed position air may be drawn thereover through air dilution opening 34 by exhaust fan 31, thereby cooling the door means.

Since the temperature of the gases within preheat furnace 2 are normally at least about 2300° F.(1260° C.), the bottom surface of door is preferably refractory lined, as indicated at 35*b*. The bottom surface of the door means 35 may make a seal with conduit 30 simply by virtue of the weight of the door means. Additional gasket means or other sealing devices (not shown), well known in the art, may be employed between the door means 35 and conduit 30. The door means, itself, may take any one of a number of forms. It may, for example, constitute a two-part structure, the parts being shiftable or swingable to a closed or sealed position. For purposes of an exemplary illustration, the door 35 is illustrated diagrammatically as simply being a slab-like structure. The door means may be provided with rollers or wheels (two of which are shown at 36) and mounted on tracks (one of which is shown at 36*a*) mounted to either side of conduit 30 so that it may be shifted between its open or retracted position and its extended or closed position. This shifting may be accomplished, for example, by fluid cylinder means diagrammatically indicated at 37, operatively attached to the door means 35, as at 38. Upon the occurrance of a line stop, the fluid cylinder 37 may be arranged to be actuated automatically to shift the door means 35 to its sealing position.

Door means 35 must be so positioned with respect to conduit 30 as to be capable of sealing direct fired furnace 32 from exhaust fan 31 and air dilution opening 34 (if present). As indicated above, to locate door means 35 in association with air dilution opening 34 provides the advantage of being able to cool door means by drawing ambient air thereover through air dilution opening 34 when the door is in its sealing position.

At the time of a line stop, the present invention also contemplates the addition of excess flow of a safe, non-oxidizing atmosphere into the strip preparation furnace. Nitrogen, for example, may be used for this purpose. The excess nitrogen serves as a safety factor. In addition, it prevents the formation of oxide and scale on the surfaces of that portion of the ferrous base metal strip 9 located within the strip preparation furnace, as well as the detrimental effect on the molten coating metal bath and equipment, as described above. Furthermore, the excess nitrogen flow will prevent that portion of the ferrous base metal strip 9 within the direct fired furnace 2 and the controlled atmosphere heating furnace 3 from over-heating to the extent of damage to or breakage of the strip.

The excess nitrogen flow can be introduced into the strip preparation furnace through existing inlets for the various atmospheres of the parts, the existing inlets (not shown) being provided with appropriate valve means, or it may be introduced through a separate purge valve, or by both. A purge valve may be located at any appropriate position in the strip preparation furnace. For purposes of an exemplary showing, a purge valve is diagrammatically indicated at 39 in FIG. 1. The purge valve 39 may, for example, be a motor operated valve which is automatically actuated at the time of a line stop. The excess nitrogen flow should be at a sufficient positive pressure to prevent the passage of oxygen from the ambient air into the strip preparation furnace through any openings, seams, or the like therein.

In the operation of the present invention, at the time of a line stop the door means 35 will be shifted to its extended or closed position to seal off the strip preparation furnace from exhaust fan 31 and air dilution opening 34. The other end of the strip preparation furnace will, of course, be sealed by virtue of the fact that the free end of snout 6 extends below the surface of molten metal bath 7.

At the same time, purge valve 39 is activated to introduce an excess of nitrogen into the strip preparation furnace 1 at a positive pressure. Both the door 35 and the purge valve 39 may be set up to be actuated automatically upon the occurrance of a line stop.

Modifications may be made in the invention without departing from the spirit of it.

The embodiments of the invention in which an exclusive property or privilege is claimed are defined as follows:

1. In a coating line for coating a ferrous base metal strip with a molten coating metal, said coating line being of the type having a strip preparation furnace comprising a direct fired furnace with an exhaust system for products of combustion comprising a duct leading from said direct fired furnace to an exhaust fan, a controlled atmosphere heating furnace, at least one cooling chamber and a snout extending beneath the surface of a bath of said molten coating metal, all connected serially in sealed relationship, the improvement comprising an air dilution opening in said duct in the form of a gap in said duct to cool and dilute said products of combustion ahead of said fan, heat resistant door means shiftable between an open position out of said gap and a closed position within said gap to seal said direct fired furnace from said exhaust fan and said air dilution opening, means to shift said door means from said open position to said closed position at the time of a line stop, said door means being thinner than said gap so that said exhaust fan draws ambient air through the upper portion of said gap and over said door means when said door means is in said closed position to cool said door means, and means at the time of a line stop to introduce a non-oxidizing atmosphere at a positive pressure into said strip preparation furnace to purge said strip preparation furnace and to prevent oxygen from the ambient atmosphere from entering said strip preparation furnace.

2. The structure claimed in claim 1 wherein said means to introduce said non-oxidizing atmosphere at a positive pressure comprises a purge valve located in said strip preparation furnace.

3. The structure claimed in claim 2 wherein said non-oxidizing atmosphere is nitrogen.

4. The structure claimed in claim 1 wherein said door means comprises a slab-like, refractory lined door.

5. The structure claimed in claim 13 wherein said means to introduce said non-oxidizing atmosphere at a positive pressure comprises a purge valve located in said strip preparation furnace.

* * * * *